United States Patent [19]

D'Agnolo

[11] 4,433,815

[45] Feb. 28, 1984

[54] TUBE WHICH CAN BE AXIALLY STACKED

[75] Inventor: Armando D'Agnolo, Porcia, Italy

[73] Assignee: Officine Savio S.p.A., Italy

[21] Appl. No.: 309,508

[22] Filed: Oct. 7, 1981

[30] Foreign Application Priority Data

Oct. 10, 1980 [IT] Italy ..... 83447 A/80

[51] Int. Cl.[3] ..... B65H 75/18

[52] U.S. Cl. ..... 242/118; 138/155; 285/DIG. 22

[58] Field of Search ..... 138/155, 109, 113, 114, 138/148; 87/55; 242/42, 118, 118.3, 118.41, 130, 130.4, 134, 139; 285/DIG. 22, 302; 57/13, 17, 18, 127.5, 127.7; 206/503, 509; 428/33, 36

[56] References Cited

U.S. PATENT DOCUMENTS

| | | | |
|---|---|---|---|
| 1,930,285 | 10/1933 | Robinson | 138/113 X |
| 2,490,363 | 12/1949 | Lang | 285/DIG. 22 X |
| 3,044,246 | 7/1962 | Schippers | 57/127.5 X |
| 3,245,703 | 4/1966 | Manly | 285/DIG. 22 X |
| 3,301,506 | 1/1967 | Bagby | 242/118.41 X |
| 3,784,235 | 1/1974 | Kessler et al. | 285/DIG. 22 X |
| 4,111,464 | 9/1978 | Asano et al. | 285/DIG. 22 X |
| 4,157,194 | 6/1979 | Takahashi | 138/109 X |
| 4,211,259 | 7/1980 | Butler | 138/155 X |

FOREIGN PATENT DOCUMENTS

| | | | |
|---|---|---|---|
| 1219051 | 6/1966 | Fed. Rep. of Germany | 138/109 |
| 2755915 | 5/1979 | Fed. Rep. of Germany . | |
| 419929 | 3/1967 | Switzerland . | |

*Primary Examiner*—Stephen Marcus
*Assistant Examiner*—Mark Thronson
*Attorney, Agent, or Firm*—Stevens, Davis, Miller & Mosher

[57] ABSTRACT

A hand manipulated tube which can be axially stacked and is able to sustain bobbins that can be stacked, one against another, at least for doubling and twisting operations comprising an outside section which is at least partially elastic radially and disposed circumferentially, and which bears protrusions positioned lengthwise in respect of an end face of a portion of the tube, and which extend radially outwards, an inner circumferential seat in the portion of the tube positioned in respect of the other end of the tube whereby the partially radially elastic side cooperates with the inner circumferential seat for the positioning of two axially stacked tubes, axial guides within the tube and possibly a radially guiding and tensioning element between one tube and another.

2 Claims, 9 Drawing Figures

TUBE WHICH CAN BE AXIALLY STACKED

This invention relates to a tube which can be axially stacked and advantageously employed in twisting and doubling operations.

To be more specific, the invention relates to carrying tubes used for bobbins that can be stacked. The stacked bobbins advantageously should enable the yarn which has to be twisted and doubled, to be unwound with one single rotary motion.

Stackable tubes are known which can be installed coaxially on a sleeve which is positioned so as to pass through inside them. The sleeve acts as a circumferential clamping element for the stacked tubes and consists essentially of a hollow cylinder fitted so that it can be removed from the tube holder. If it is to be brought about, this solution requires a complex installation. Moreover, it needs the use of a supplementary clamping sleeve which is expensive.

Other kinds of tubes exist which can be stacked and connected to each other with screw systems which involve many drawbacks during the phase of mutual installation. These kinds have a reciprocal anchorage which, after a given number of coupling operations, become worn to such an extent as to be inadequate and unacceptable.

There are also available in the known art stackable tubes which employ insertion systems with catches. These systems embody on each of the two axial ends of the tubes a different circumferential configuration so that, when said axial ends are engaged with each other, they are able to complement each other reciprocally.

In particular, patent No. DE-PS No. 1880671 in the name of Montaplast presents some connecting solutions for tubes which can be stacked by insertion with catches.

A further embodiment of this type is described in DE-AS No. 2755915 mentioned in EPO Standard Research Report RS 63270 IT which proposes a similar coupling of the tubes with the difference that it allows a self-regulation of the axial position of one tube in relation to the other.

In this solution the insertion and removal of the stackable tubes take place forcibly owing to the special circumferential conformation of the axial ends to be coupled, which are characterised by appreciable and sharp variation in the diameters of the parts able to complement each other.

While this special conformation ensures the coupling, yet it leads to a quick deterioration of the parts engaged with and complementing each other, and the parts undergo appreciable deforming stresses during the coupling and uncoupling actions. Patent DE-GM No. 6928283 in the name of NINO offers another solution for the connection of tubes which can be stacked by axial insertion systems with catches. This solution stacks the tubes by means of circumferential or diametral deformation of their stiff axial ends being engaged with each other and able to complement each other reciprocally when connection has taken place.

During the phase of coupling or uncoupling the stiff axial ends with a low coefficient of elasticity, the temporary deformations thereof cause quick deterioration and a consequent loss of the clamping capacity of the ends able to be coupled together.

In the solutions offered in the known art there is also the drawback of inconvenient handling of the single or stacked bobbins owing to the lack of suitable elements or structures to be gripped with the hand.

In the known art there are also tubes in which the parts being coupled cooperate with each other by means of elastic interference rings positioned in a suitable circumferential seating on one axial end of the tubes.

During the coupling of the tubes the position of the elastic rings is modified, and the rings become positioned in another circumferential seating near the previous seating, and carry out their clamping function in said circumferential seating.

In the known solution, during the phase of coupling or uncoupling the tubes the elastic rings become positioned in the undesired positions. They therefore have to be continually examined.

The main purpose of the present invention is to provide tubes which can be stacked and are able to be coupled together axially by means of a stable and lasting connection able to retain its characteristics in the long term notwithstanding constant use.

Another purpose of the invention is to facilitate assembly or stacking of the tubes with easy maneuvers that can even be carried out far from the machine.

Yet another purpose is to produce tubes which can be stacked, cost little and, notwithstanding that, have a long life.

A further purpose of the invention is to realize stackable tubes that cooperate with guide elements able to stretch the yarn so as to prevent the yarn from becoming slack. This enables losses of material through slackening to be eliminated. The losses are, instead, normally to be found when tubes that can be stacked are used which have been realized according to the known art.

Lastly, it is a purpose of the invention to provide tubes, which whether single or stacked, can be readily manipulated at least by hand during transfer or positioning operations.

The invention provides at the axial ends of the tubes interference means comprising flexible parts which, by being deformed elastically during the coupling phase, anchor themselves to each other in coordinated cooperation.

According to the invention each tube has at one of its axial ends a suitable element or structure to be gripped by hand and able to facilitate the handling of the stackable tube or tubes by the machine operator.

A guide element is also provided which is conformed like a circular crown or flange and is interposed axially between two stacked tubes. In particular, the circular crown or flange element is positioned between the opposed end faces of two stacked tubes and performs the function of guiding and tensioning the yarn unwinding from the bobbin.

In substance the invention is embodied in an axially stackable tube suitable for use with bobbins employed for doubling and twisting processes, the tube being characterized by the facts that at the two axial ends of the tube means are provided which are at least partially flexible and interfere elastically and reciprocally with a definite position of reciprocal anchorage and positioning, and that at one axial end of the tubes there are means for manual gripping which protrude axially from the body of the tubes.

The invention, therefore, is embodied in a tube which can be stacked axially and is able to bear bobbins which can be stacked against each other at least for a doubling and twisting operation, whereby the tube can also be manipulated by hand and is characterized by:

a first external section which is at least partially elastic radially and positioned circumferentially and bears interference elements which are disposed lengthwise in respect of an end face of a second section and which extend outwardly radially and are placed at one end of the tube, an inner circumferential seat positioned in respect of the other end of the tube and cooperating with a circumferential lodgement, whereby there is a circular crown element for radially guiding and tensioning the yarn and the circular crown element can be positioned between the opposing end faces of the two tubes that can be stacked axially, and whereby the external section which is at least partially elastic radially act as means to be gripped by hand and cooperates with the inner circumferential seat for the mutual anchoring and positioning of two axially stacked tubes, there also being axial guides.

Other details and features of the invention will stand out from the description given below by way of non-limitative example and with reference to the accompanying drawings, in which:

FIG. 1 shows a view in ortographic projection of the tube;

FIG. 2 gives a view in ortographic projection of the profile of the tube of FIG. 1 cutaway along the line 2—2;

In the figures shown the same parts or parts able to perform the same functions bear the same reference numbers.

Figure 1:
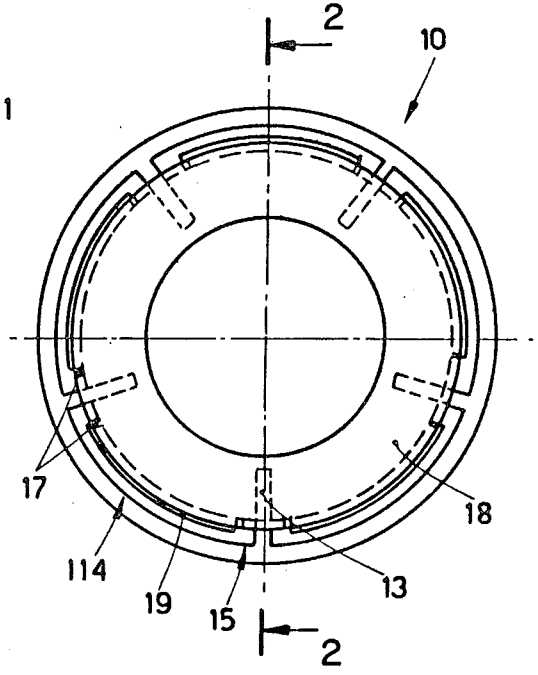
Figure 2:
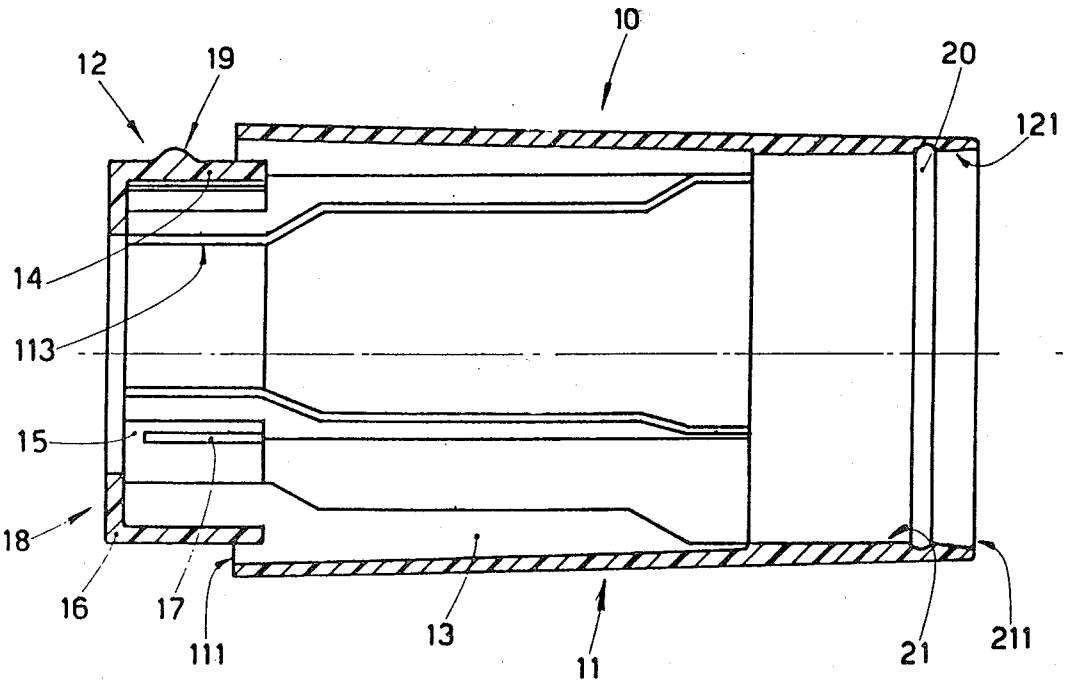
Figure 3:
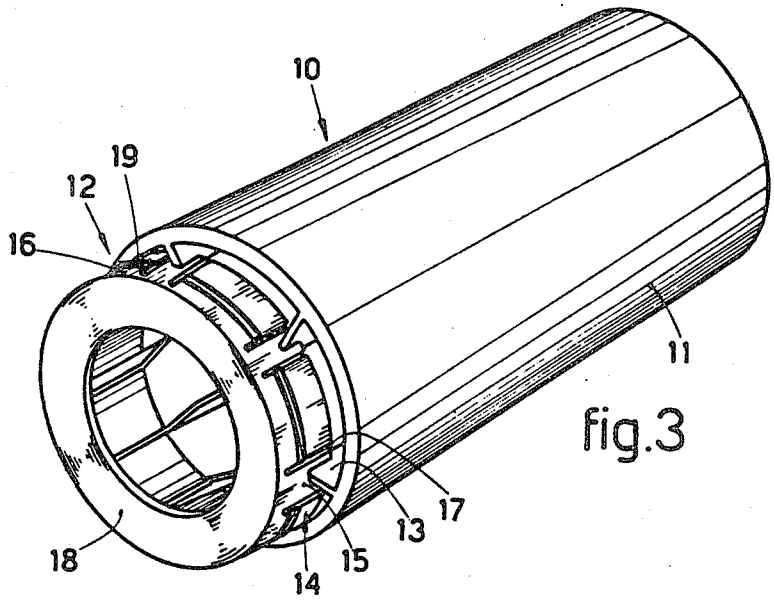
FIG. 3 shows a three-dimensional view of the tube of FIG. 1.

FIGS. 1, 2 and 3 show diagrammatically a stackable tube 10 having a conical body which is not essential but having protruding axially therefrom a manual grip element, or grip means or external means at least partially elastic radially. The manual grip element 12 has a cylindrical shape or, more generically, a tubular shape with a regular or irregular polygonal section and is anchored firmly to the body 11 of the tube 10 with length-wise fins or ribs 13.

Fins 13 constitute a support for the manual grip element 12 and, at the same time, act with their inner part 113 as guide elements to facilitate and improve the insertion and positioning of the stackable tubes 10 on the tubeholder structure (not shown).

The fins 13 are disposed in a number great enough to provide a good connection between the manual grip element 12 and the body 11.

Next, the number and disposition of the fins 13 realize an adequate clamping of rigid sectors or radially rigid zones 15 alternating circumferentially with the flexible sectors or radially movable zones 14 present on the manual grip element 12 which protrudes from the body 11 of the tube 10 but is positioned exactly in respect to the end face means III of said tube 10.

In the example shown the fins 13 are arranged lengthwise within the stackable tube 10 over a great part of the length of the tube 10. However, it is possible to limit the size of the fins 13 considerably within the body II and it is also possible to limit their presence within the manual grip element 12.

According to a further embodiment it is possible to provide, instead of the fins 13, some radial coupling elements between the body 11 and the manual grip element 12, to correspond with their facing zones.

The manual grip means 12 comprise on themselves the flexible sectors 14 and rigid sectors 15 alternating with each other circumferentially and separated from each other with lengthwise notches 17 of a suitable length.

To the unmoving sector 15 are connected the lengthwise fins 13, which can advantageously constitute the end face and positioning means 111.

In the example shown the manual grip element 12 is embodied with smooth edges 16 so as to enable the yarn unwound from the bobbin to run easily and without any risk of being entangled with any corners of the tube 10.

A protrusion occupying sector of circumference, or interference means, 19 which is only present in the flexible sectors 14 is able to be engaged (FIG. 4) elastically in a suitable hollow or circumferential seat 20 present in the inner surface of the lodgement section 21 in the opposite end of the tube 10. An element 23 to guide the yarn radially and to tension it can be in the form of a circular crown or flange. The flange can consist of concentric circular crowns connected by means of radial elements or spokes, or could be conformed in another way.

To bring about the coupling, the element 23 is inserted axially on that end of the tube 10 in which there is the manual grip element 12.

The insertion is completed when the inner circumferential edge 24 of element 23, an edge 24 consisting of a raised ring, is made to mate with the lengthwise positioning base 111 of the tube 10. Steps are then taken to engage the two tubes 10 axially.

During the engagement the inner surface 21, in which are made the circumferential seating or hollow means 20, accommodates the element 12, the rigid sectors 15 of which fit therein circumferentially.

Instead, the flexible sectors 14 comprise the interference means 19 present thereon.

Owing to the mutual action of the entrance 121 together with the conformation of the protrusion 19, and axial thrust pressure being applied, the flexible sectors 14 bend and permit a further forward movement of the element 12 into the lodgement section 21.

Whenever the element 23 is not present, the end 211 moves forward against the end face and positioning means 111. The flexible sectors 14 recover, since the protrusions 19 cooperate with the circumferential hollow 20.

When the end 211 rests against the inner circumferential seating 124 of the element 23, the seating 124 consisting of an annular recess or lodgement permitting a better mating of the parts being coupled together, the flexible sectors 14 recover, because the protrusions 19 cooperate with the circumferential hollow 20.

It should be noted that the protruding and recessed shapes of the inner circumferential protruding edge 24 and inner circumferential seating 124 respectively could be excluded, or different shapes could be present.

Figure 4:
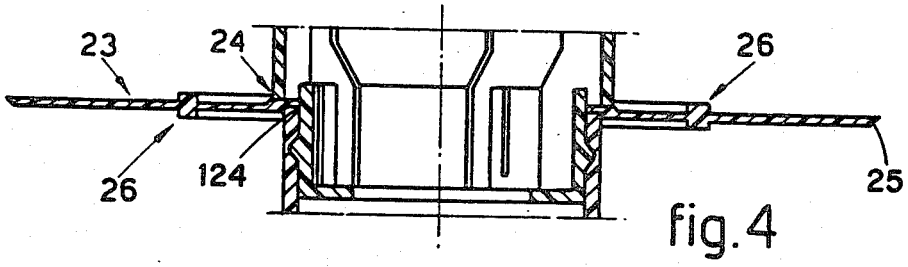
FIG. 4 shows a detail of an axial coupling of two tubes cutaway with the guide element interposed.
Figure 5:
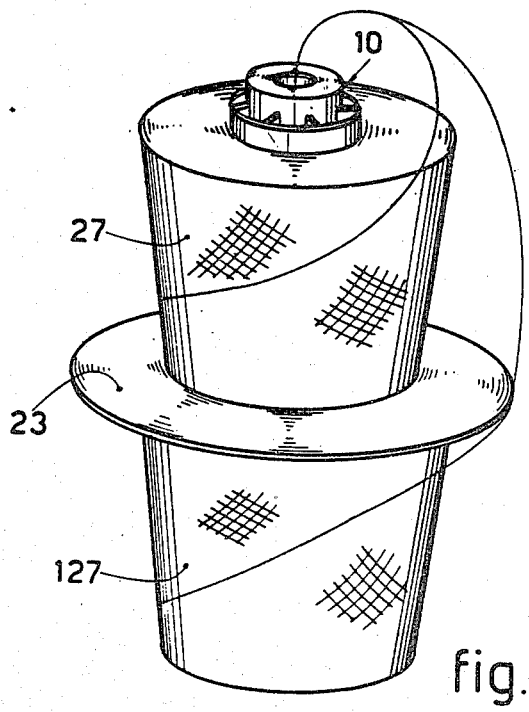
FIG. 5 shows a diagrammatic three-dimensional view of two bobbins joined together and stacked according to the invention.

Furthermore, the outer circumferential edge 25 of the element 23 can be bevelled, as in the example of FIGS. 4 and 5 at diverse angles so as to facilitate the running of the yarn. The bevelling, however, can be omitted although it remains within the scope of this invention. On the faces of the element 23 to guide and tension the yarn there can also be present protrusion means 26 conformed in the manner of a circular crown or, according to a variant, with circular sectors having any desired shape, thickness and size, able to cooperate with each other when a plurality of the elements 23 is applied, one against another.

In this way an interspace is created between each pair of elements 23 applied.

This enables the storage or withdrawal of stacked elements 23 to be carried out with suitable jaws or suitable lamellar distributing elements able to be inserted temporarily and radially in the interspace so as to correspond with the outer or inner edge of the elements 23.

The protrusions 26 can be realized in an intermediate circumferential position on the element 23, as shown in FIG. 4. The protrusion means 26 can also correspond with the outer or inner edge.

It is also possible for the protrusion means 26, as described, to be present only on one face of the element 23 that guides and tensions the yarn.

When the protrusion occupying sectors of circumference 19, or the interference means 19, coincides with the circumferential seating 20, it is engaged with a jump and clamps two tubes 20 in one single structure.

Owing to their bow-shaped conformation and the orientation of their flexibility, the flexible sectors 14 exert, when the stackable tubes 10 are being disengaged from each other, greater resistance to the unclamping than they did during the phase of mutual engagement.

This leads to a better grip of the coupling realized between stackable tubes 10.

Moreover, the flexible coupling system as shown obviates the the occurence of radial strains in the interacting parts and ensures for the stackable tubes 10 an almost unending working life notwithstanding the great number of times they are handled.

FIG. 5 shows diagrammatically the combining of two bobbins 27,127 stacked according to the solution offered by this invention, with the yarns to be doubled unwinding from them. Further embodiments of the invention are possible.

Figure 6:
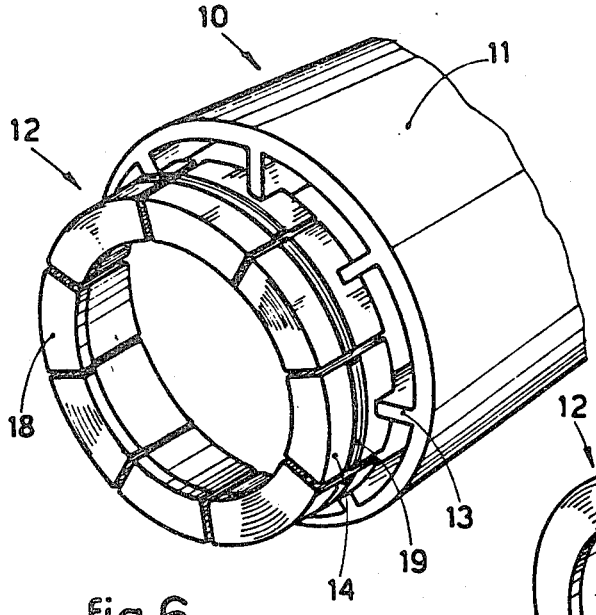
FIG. 6 shows diagrammatically a second embodiment of the flexible sectors obtained on the element for gripping by hand.
Figure 7:
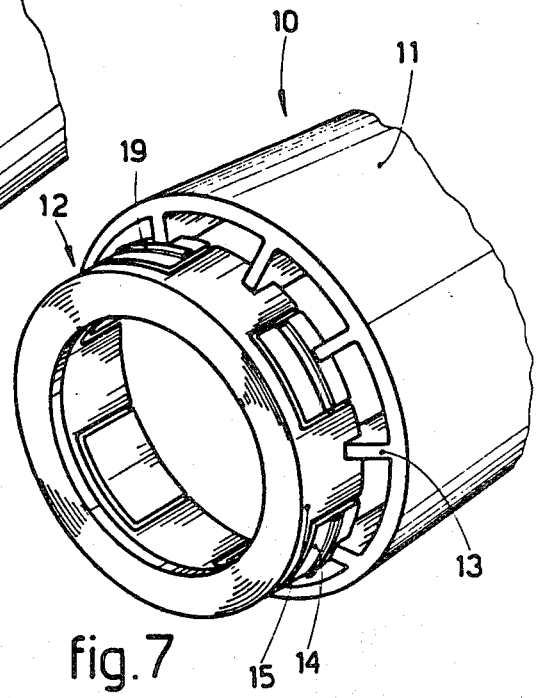
FIG. 7 shows diagrammatically a third embodiment of the flexible sectors obtained on the element for gripping by hand.

Thus it is possible to realize flexible sectors 14 as shown in FIG. 6. The flexible sectors 14 are anchored to the body 11 with suitable connecting means. In particular, the employment of fins 13 as shown and described earlier can be used. In substance, according to the second embodiment of FIG. 6 the manual grip element 12 consists only of flexible sectors 14. According to a third embodiment to the stackable tubes 10, as shown in FIG. 7, the structural continuity of the edges 16 is maintained.

This is brought about by realizing in the manual grip element 12 an unmoving part comprising the rigid sectors 15 and conformed as already shown in FIGS. 1 to 4 inclusive.

The flexible elements 14 are anchored with suitable connecting means to the body 11 of the stackable tube 10 and have their flexible part positioned near the edges 16 of the manual grip element 12.

Figure 8:
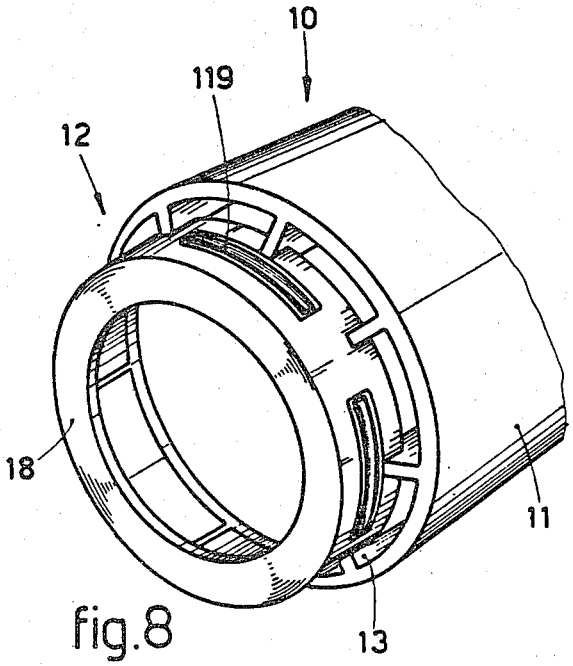
FIG. 8 shows diagrammatically a fourth embodiment of the flexible sectors obtained on the element for gripping by hand.
Figure 9:
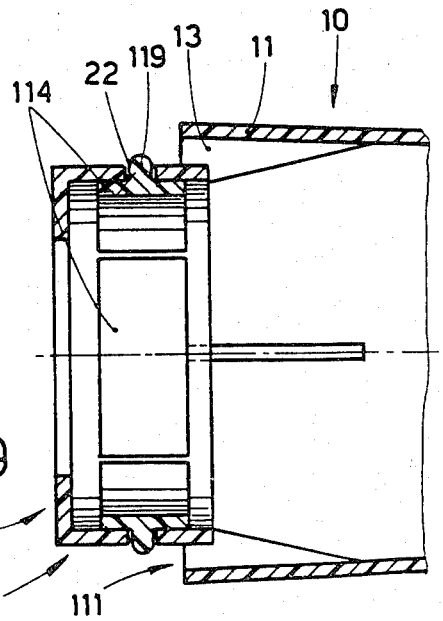
FIG. 9 shows diagrammatically a section of the view of FIG. 7.

According to a fourth embodiment shown in FIGS. 8 and 9, the flexible sectors 14, as shown in the preceding figures, have been replaced by elements consisting of sectors 114 which can be shaped diversely and are partially anchored or welded circumferentially to the inside of the manual grip element 12. The elements consisting of sectors 114 are conformed so as to have a flexible part comprising protruding elements 119 wholly like the sectors of circumference 19 shown in the preceding figures. The protruding elements 119 jut out from the openings 22 conformed with sectors of circumference and made in the manual grip element 12.

While two stackable tubes 10 are being connected together, the flexible elements of one of them bend at first towards the inside of the tube and are then engaged in the circumferential seating 20 of the other.

FIG. 8 can be varied by providing openings 22 and circumferential elements 113 rather than elements divided into sectors, suitable bridges to sustain the edges 16 being provided and being located within the manual grip element 12.

According to this variant the protruding elements 119 can be circumferential or divided into sectors of the circumference. It is possible to provide several openings 22 and, therefore, several elements 114 or several protruding elements 119 divided into sectors of the circumference and disposed lengthwise and circumferentially in the manual grip element 12, whereby the elements are disposed in an aligned or staggered manner.

Possible embodiments of the invention have been described, but further variants are possible for a technician in this field without departing thereby from the scope of the invention.

Thus, the proportions and sizes can be varied, and it is possible to add, remove or integrate parts. These and other variants remain within the scope of the invention.

I claim:

1. An axially stackable tube able to sustain bobbins for doubling and twisting operations, comprising a first tubular section defining circumferential alternating rigid and radially elastic segments, each said radially elastic segment defining an arcuate circumferential interference element on the outside thereof, a second tubular section fixed to said first section axially beyond an end face of said second section by axial radial guides positioned interiorly of said first and second sections and fixed to both sections; said second section defining an inner circumferential seat at the other end of said second section for the arcuate interference elements of a second tube whereby the first section acts as a manual grip and the arcuate interference elements of a second tube cooperate with said inner circumferential seat to axially stack two tubes.

2. The tube of claim 1 wherein said second section is tapered.

* * * * *